US006679010B2

(12) United States Patent
Honda

(10) Patent No.: US 6,679,010 B2
(45) Date of Patent: Jan. 20, 2004

(54) OVERHANGING MEMBER

(75) Inventor: Takashi Honda, Aichi (JP)

(73) Assignee: Nichiha Corporation, Nagoya (JP)

( * ) Notice: Subject to any disclaimer, the term of this patent is extended or adjusted under 35 U.S.C. 154(b) by 60 days.

(21) Appl. No.: 10/037,886

(22) Filed: Jan. 4, 2002

(65) Prior Publication Data

US 2002/0088189 A1 Jul. 11, 2002

(30) Foreign Application Priority Data

Jan. 5, 2001 (JP) ..... 2001-000415
Jan. 5, 2001 (JP) ..... 2001-000382

(51) Int. Cl.[7] ..... E04B 7/00; E04D 13/00; E04D 3/40

(52) U.S. Cl. ..... 52/95; 52/94; 52/96

(58) Field of Search ..... 52/94, 95, 96, 52/302.6, 287.1

(56) References Cited

U.S. PATENT DOCUMENTS

| | | | | | |
|---|---|---|---|---|---|
| 2,065,078 | A | * | 12/1936 | Lane | 49/476.1 |
| 2,705,887 | A | * | 4/1955 | Xanten | 52/125.2 |
| 3,174,421 | A | * | 3/1965 | Gray | 454/260 |
| 3,256,654 | A | * | 6/1966 | Pinckney | 52/95 |
| 3,766,694 | A | * | 10/1973 | Minialoff et al. | 52/95 |
| 4,109,428 | A | * | 8/1978 | Aarons | 52/94 |
| 4,186,531 | A | * | 2/1980 | Okolischan | 52/11 |
| 4,347,691 | A | * | 9/1982 | Lloyd-Jones | 52/95 |
| 4,381,630 | A | * | 5/1983 | Koester | 52/169.5 |
| 4,461,128 | A | * | 7/1984 | Knoebl | 52/94 |
| 5,328,406 | A | * | 7/1994 | Morris et al. | 454/260 |
| 5,560,157 | A | * | 10/1996 | Rotter | 52/95 |
| 5,560,158 | A | * | 10/1996 | Norton | 52/95 |
| 5,718,086 | A | * | 2/1998 | Dunn | 52/95 |
| 5,729,933 | A | * | 3/1998 | Strength | 52/96 |
| D396,117 | S | * | 7/1998 | Zaccagni | D25/125 |
| 5,885,153 | A | * | 3/1999 | Bateman | 454/260 |
| 5,937,594 | A | * | 8/1999 | Sourlis | 52/169.5 |
| 5,941,028 | A | * | 8/1999 | Hicks | 52/95 |
| 5,950,375 | A | * | 9/1999 | Zaccagni | 52/94 |
| 5,956,910 | A | * | 9/1999 | Sommerstein et al. | 52/235 |
| 5,996,289 | A | * | 12/1999 | Allaster | 52/95 |
| 6,026,616 | A | * | 2/2000 | Gibson | 52/95 |

FOREIGN PATENT DOCUMENTS

| | | | | | |
|---|---|---|---|---|---|
| GB | 2 227 372 | A | * | 4/1993 | F24F/7/02 |
| GB | 2 226 344 | A | * | 6/1997 | E94D/13/16 |
| JP | 09-310403 | | | 2/1997 | |
| JP | 10-037321 | | | 10/1998 | |
| JP | 11-336285 | | | 7/1999 | |
| JP | 02001011978 | A | * | 1/2001 | E04B/1/94 |
| JP | 02001098693 | A | * | 4/2001 | E04B/9/02 |
| JP | 2001-032517 | | | 6/2001 | |
| JP | 02002070264 | A | * | 3/2002 | E04D/13/152 |

OTHER PUBLICATIONS

U.S. Patent Publication US2002/0124484A1, Martin, Sep. 2002 Continuous Soffit Panel and Associated Methods.*

* cited by examiner

*Primary Examiner*—Ramon O. Ramirez
*Assistant Examiner*—Amy J. Sterling
(74) *Attorney, Agent, or Firm*—Shook, Hardy & Bacon LLP

(57) ABSTRACT

There is provided an overhanging member which is capable of improving the external design, and also capable of effectively performing the ventilation and drainage of the overhanging portion of building. This overhanging member comprises a flat vertical mounting portion; an rear mounting portion which is extended from the lower end of the flat vertical mounting portion to the backside; and a trough portion extended from the bottom portion of the rear mounting portion to the fore side of the flat vertical mounting portion; the trough portion being provided at the bottom thereof with at least one hole. Any condensation water accumulated at the overhanging portion is permitted to be drained through the hole of the trough portion.

9 Claims, 8 Drawing Sheets

OVERHANGING MEMBER

BACKGROUND OF THE INVENTION

1. Field of the Invention

The present invention relates to an overhanging member to be employed at an overhanging portion of building.

2. Description of the Related Arts

As one of the methods for constructing an overhanging portion of a building, a hanging wall specification is known. FIG. 7 illustrates one example of constructing such an overhanging portion according to the conventional hanging wall specification wherein metal fittings are employed for installing siding boards. In this case, horizontal furring strips 20 are attached to a beam 21 by making use of nails 22, after which siding boards 30 are anchored, through a packing member 25 and a sheet of water-proof paper 26, to the horizontal furring strips 20 by making use of nails 22. The packing member 25 is employed for securing a predetermined distance between the siding board 30 and the vertical fin-ring strip 24 at this overhanging portion, or the distance which can be secured also by a fixture (not shown).

FIG. 8 illustrates another example of constructing the conventional hanging wall specification. In this example, the siding boards are installed by making use of nails according to the conventional construction process. Since metal fittings are not employed in this case, the siding boards 30 are anchored to the horizontal furring strips 20 not through a packing member 25 but only through a sheet of water-proof paper 26.

In FIGS. 7 and 8, the reference numeral 23 denotes an eaves top board, which can be installed before or after the anchoring of the siding boards 30.

According to the aforementioned conventional construction processes, they fail to pay any particular attention to the ventilation and drainage of the overhanging portion, thus allowing condensation water to remain without drainage, thereby possibly resulting in the corrosion of the eaves top board, etc. by the condensation.

Further, the length of the eaves top board 23 to be installed may not necessarily be uniform in every eaves top board 23. Namely, if there is any eaves top board 23 which is shorter than other eaves top boards 23 among the installed eaves top boards 23, a gap would probably be generated between this short eaves top board 23 and the siding board 20, thereby prominently spoiling the external appearance of the over hanging portion. On the contrary, if there is any eaves top board 23 which is longer than other eaves top boards 23 among the installed eaves top boards 23, it would become impossible to install the siding board.

SUMMARY OF THE INVENTION

Therefore, an object of the present invention is to provide an overhanging member which is capable of overcoming the aforementioned problems that have been accompanied with the overhanging portion of the conventional hanging wall specification, capable of effectively executing the ventilation and drainage of the overhanging portion, and capable of improving the external appearance of the over hanging portion.

Namely, the present invention provides an overhanging member comprising a flat vertical mounting portion; a rear mounting portion that extends from the lower end of the flat vertical mounting portion to the backside; and a trough portion that extends parallel with said rear mounting portion;

wherein one side brim of said trough portion is made contiguous with the bottom portion of said rear mounting portion; the other side brim of said trough portion extends to the fore side beyond the front face of said flat vertical mounting portion; and said trough portion is provided at the bottom thereof with at least one hole.

According to a preferable embodiment of the present invention, said trough portion is constituted by an inclined face, which is extended obliquely downward from the bottom portion of said rear mounting portion to a front side of said flat vertical mounting portion; a bottom face horizontally extending from the distal end of said inclined face and provided with at least one hole; and a vertical face extending perpendicularly from the distal end of said bottom face.

In another preferable embodiment of the present invention, said trough portion is constituted by a first vertical face which is extended perpendicularly downward from the bottom portion of said rear mounting portion; a first inclined face which is extended obliquely downward from the lower end of said first vertical face to front side of said flat vertical mounting portion; a second inclined face which is extended obliquely upward from the distal end of said first inclined face; a second vertical face perpendicularly extending from the distal end of said second inclined face; and at least one hole formed along the joint line between said first and second inclined faces.

Since the overhanging member is constructed as described above according to the present invention, when this overhanging member is attached to an overhanging portion of building, any condensation water that has been generated at the overhanging portion is permitted to flow into the trough portion and to fall downward through the holes formed in the trough portion, thereby enabling the condensation water to be effectively drained. Additionally, due to the introduction of air through the holes into the inner side of siding boards, the ventilation can be ensured at this overhanging portion of building.

As described above, according to the conventional construction method of the overhanging portion of building, a gap may be formed between the siding board and the eaves top board due to an insufficient length of some of the eaves top boards. Whereas according to the present invention, since the distal end portions of the eaves top boards are entirely covered by the overhanging member of the present invention, the problem of generating the aforementioned gap can be overcome even if there is some degree of dimensional error in length of the eaves top boards. Further, it becomes possible, through the employment of the overhanging member of the present invention, to secure a substantial degree of freedom in terms of the length of the eaves top boards to be employed. Moreover, since the overhanging member can be installed in such a manner that the fore-end portion of the trough portion, which is extended toward the front side of the flat vertical mounting portion is able to contact the rear side of siding board, all of the structural members including a distal end portion of the eaves top board located behind the overhanging member, the overhanging member and the siding board appear to contact each other as they are viewed from below, thereby greatly improving the external appearance of the overhanging portion of a building.

The procedure for installing the siding boards by making use of the overhanging member of the present invention may be generally such that the eaves top boards are attached in advance to a building frame prior to the installation of the overhanging member and the siding boards. However, depending on circumstances, the overhanging member and the siding boards may be anchored at first to a beam prior to the attachment of the eaves top boards to a building frame. This means that the degree of freedom in the procedure for installing the overhanging member is relatively large.

In another preferable embodiment of the present invention, the overhanging member comprises a flat vertical mounting portion; a step portion extended from the lower end of said flat vertical mounting portion to the front side and forming a flat surface parallel with said flat vertical mounting portion; a rear mounting portion extending from the lower end of said step portion to the backside; and a trough portion extending parallel to said rear mounting portion; wherein one side brim of said trough portion is made contiguous with the bottom portion of said rear mounting portion; the other side brim of said trough portion extends to the fore side beyond said step portion; and said trough portion is provided at the bottom thereof with plurality of holes. According to this embodiment, the installation of the vertical furring strips can be performed in a manner that the lower end of each of the vertical furring strips is placed on the step portion thereby facilitating the positioning of the vertical furring strips.

According to another preferable embodiment of the present invention, the trough portion of the overhanging member is provided at the bottom thereof with at least one groove portion running along the bottom thereof, said groove being provided at the bottom thereof with at least one hole.

According to this embodiment, any condensation water that drops into the trough portion of the overhanging member is permitted to flow along the groove formed along the bottom of the trough portion and to fall downward through the holes formed in the groove, thereby enabling the condensation water to effectively drain outside. Even though the quantity of condensation water generated at the overhanging portion and flowing into the trough portion wouldbe small, the grove thus formed functions as a conduit, thereby turning the condensation water in a flow of water, thus achieving a smooth drainage of water. In particular, if the hole is formed of a narrow slit, water would be kept in a state of thin layer due to the surface tension, thus preventing water from falling down through the slit. However, when a groove is formed as described above, such a phenomenon can be avoided.

In a further preferable embodiment, the trough portion is provided with a couple of grooves running along both side brims of the bottom of the trough portion, and slits extending from the bottom of one of the grooves to the bottom of another groove are formed at predetermined intervals along the entire length of the groove trough portion. In view of the width of the trough portion using the overhanging member of the present invention, the provision of a couple of grooves on both side brims of the bottom of the trough portion as illustrated in this embodiment would be suitable. The overhanging member of the present invention can be formed generally by means of bending work of a steel plate. Therefore, if the trough portion of the overhanging member is constructed so as to provide a couple of grooves on both side brims of the bottom of the trough portion, a sufficient drainage effect can be achieved with a relatively small degree of the bending work. Further, since the holes in the bottom of the trough portion are formed of slits according to this embodiment, the inner side of the holes can be made hardly recognizable as the overhanging portion is viewed from below, thereby improving the external appearance of the overhanging portion.

According to another preferable embodiment, the trough portion of the overhanging member is provided, at the flat vertical mounting portion, with a hole or a groove for nailing. According to this embodiment, the nailing work of the overhanging member to the frame construction of building can be facilitated.

The overhanging member of the present invention can be manufactured from a steel plate. With respect to the manufacturing method and raw material of the steel plate, there is not any particular limitation as long as a predetermined strength can be ensured. Preferably, the overhanging member of the present invention should be manufactured through the bending work of a single steel plate.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
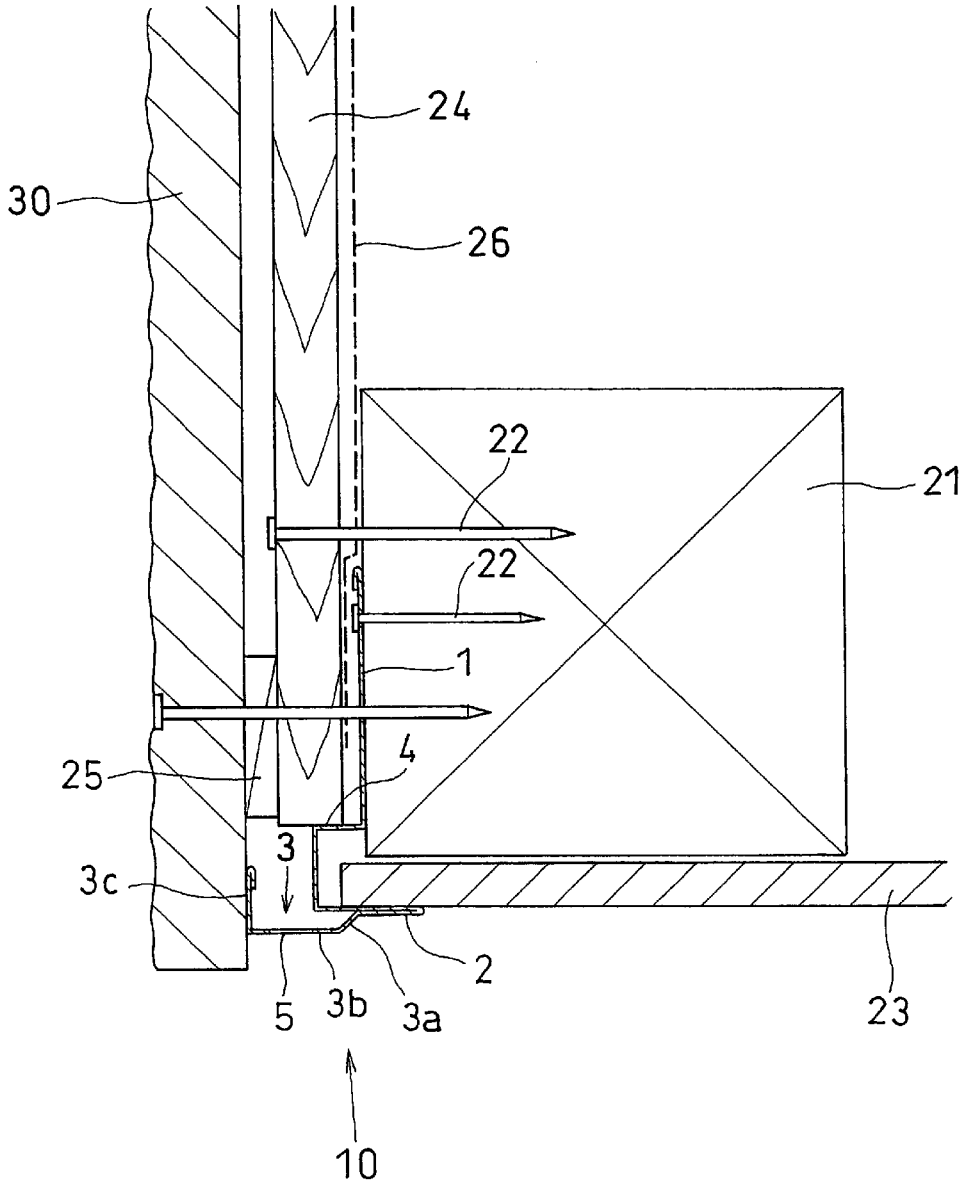
FIG. 1 is a cross-sectional view illustrating a state wherein an overhanging member of the present invention is attached to an overhanging portion of building.
Figure 2:
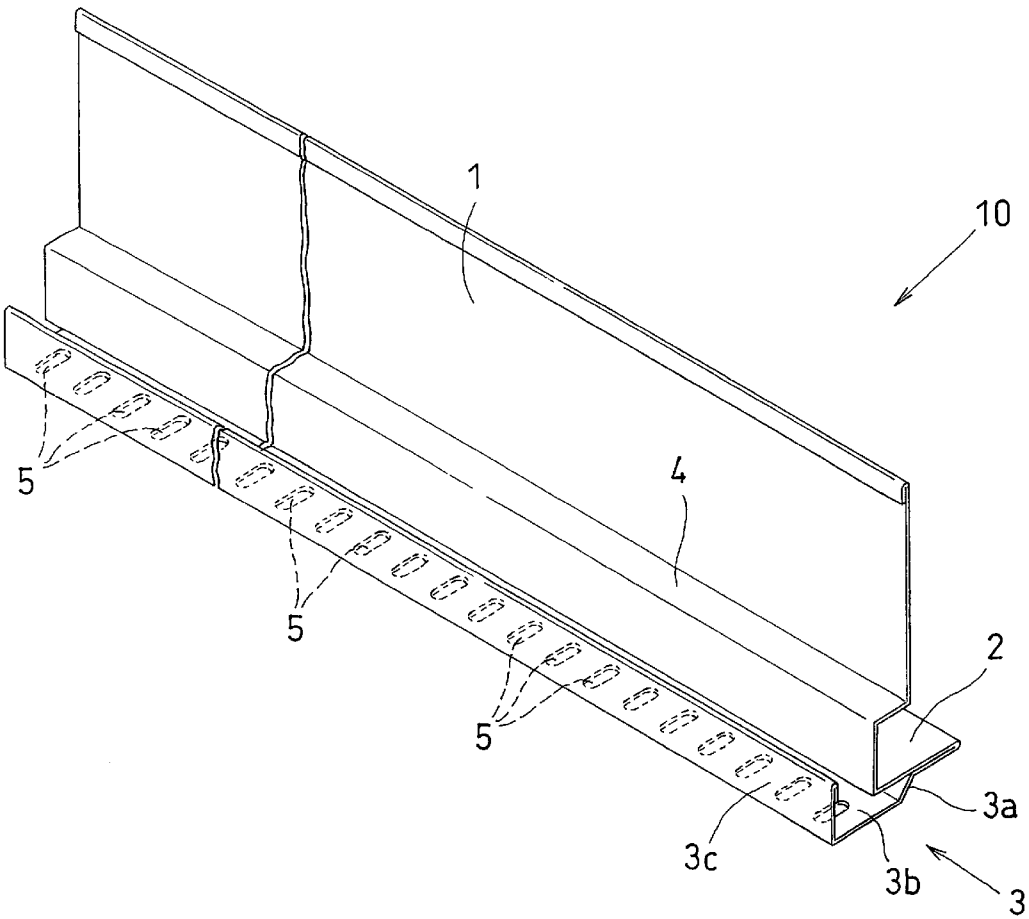
FIG. 2 is a perspective view illustrating the overhanging member shown in FIG. 1.

One embodiment of the overhanging member according to the present invention will be further explained with reference to drawings. FIG. 1 shows a cross-sectional view illustrating a state wherein an overhanging member 10 of the present invention is attached to an overhanging portion of building. This overhanging member 10 is made from a thin steel plate and manufactured through the bending work of a single steel plate as shown in FIG. 2.

This overhanging member 10 has an elongated configuration as a whole and is provided at an upper portion thereof with a flat vertical mounting portion 1 having a flat plate-like configuration, this flat vertical mounting portion 1 constituting the attachment face of the overhanging member 10 to the frame structure of building, i.e. to a beam 21. The portion extended from the lower end of the flat vertical mounting portion 1 is bent toward the fore side by an angle of 90° and further bent downward by an angle of 90° to thereby form a step portion 4. The portion extended from the lower end of the step portion 4 is bent horizontally rearward by an angle of 90° to thereby form an rear mounting portion 2. By the way, in this specification, the fore side of the flat vertical mounting portion 1 is referred to as front or forward, while the rear side thereof is referred to as backward or rearward. The portion extended from the distal end of the rear mounting portion 2 is downwardly folded back so as to be laminated on the rear side of the rear mounting portion 2. The length of the portion laminated on the rear side of the rear mounting portion 2 is shorter than the width of the rear mounting portion 2 and the fore portion extending from this laminated portion is bent downward by an angle of 45° to thereby form an inclined face 3*a*. The fore portion extending from the distal end of this inclined face 3*a* is bent forward horizontally to thereby form a bottom face 3*b*. The fore portion extending from the distal end of this bottom face 3*b* is perpendicularly bent upward by an angle of 90° to thereby form a vertical face 3*c*. The trough portion 3 is constituted by these inclined face 3*a,* bottom face 3*b* and vertical face 3*c*.

A plurality of holes 5 for ventilation and drainage are formed along the entire length of the horizontal bottom face 3*b*. As a result, even if condensation water is accumulated on the rear side of the overhanging member 10, the accumulated water can be entirely drained through these holes 5. Additionally, due to the air entering through these holes 5, a ventilation layer is secured between the siding boards 30 and the frame structure of building, thereby suppressing the generation of condensation water. Although there is not any particular limitation with respect to the configuration and location of these holes 5, the holes 5 shown in FIG. 2 are made a slot-like configuration, thereby making it difficult to recognize, as the overhanging member 10 is looked from below, the existence of furring strip 24 which is disposed on the inner side of these holes.

In the installation of the overhanging member 10 to an overhanging portion of building, the attachment of horizontal furring strips is no longer required, so that, as shown in FIG. 1, the flat vertical mounting portion 1 is directly secured to the beam 21 by making use of nails 22 under the conditions wherein an eaves top board 23 attached in advance to the lower surface of beam 21 is held on the inner side of the rear mounting portion 2 of overhanging member 10. Namely, under the conditions wherein the flat vertical mounting portion 1 is press-contacted with the sidewall of beam 21, and an upper surface of the distal end portion of the rear mounting portion 2 is press-contacted with the lower surface of the eaves top board 23, the nailing of the overhanging member 10 to the beam 21 is performed using the nails 22. As a result, the overhanging member 10 can be fixed to the overhanging portion of building.

Subsequently, a waterproof paper 26 is placed to cover the surface of the flat vertical mounting portion 1, and then, a vertical furring strip 24 is nailed by making use of the nails 22. On this occasion, the nailing can be performed under the condition wherein the lower end of the vertical furring strip 24 is placed on the step portion 4 of the overhanging member 10, thereby facilitating the positioning of the vertical furring strip 24. Then, the siding board 30 is nailed to the beam 21 with a packing material 25 between interposed between the siding board 30 and the vertical furring strip 24. On this occasion, the vertical face 3*c* of the trough portion 3 of overhanging member 10 is enabled to contact with the rear side of the siding board 30. Since it is difficult to fix the lower end of the siding board 30 of the overhanging portion by means of a fixture, the packing material 25 is used for keeping a predetermined distance between the rear surface of the siding board 30 and the vertical furring strip 24.

By the way, it is also possible to install the eaves top board 23 after the overhanging member 10 is fixed in place.

As explained above, since the distal end portion of the eaves top board 23 can be completely covered by the rear mounting portion 2, no problem would be raised even if there is some degree of error in length among the eaves top boards. Further, since all of the structural members including the eaves top board, the overhanging member and the siding board are permitted to closely contact with each other, the external appearance of the overhanging portion of building can be improved.

Even if any condensation water is caused to generate at the overhanging portion to which the overhanging member 10 of the present invention is attached, the condensation water can be permitted to flow into the trough portion 3 and to fall downward through the holes 5 formed in the bottom portion 3*b,* thereby enabling the condensation water to be effectively drained outside. Additionally, due to the introduction of air through the holes 5 into the space between the rear side of the siding board 30 and the building frame, the ventilation can be ensured at this overhanging portion of building.

Figure 3:
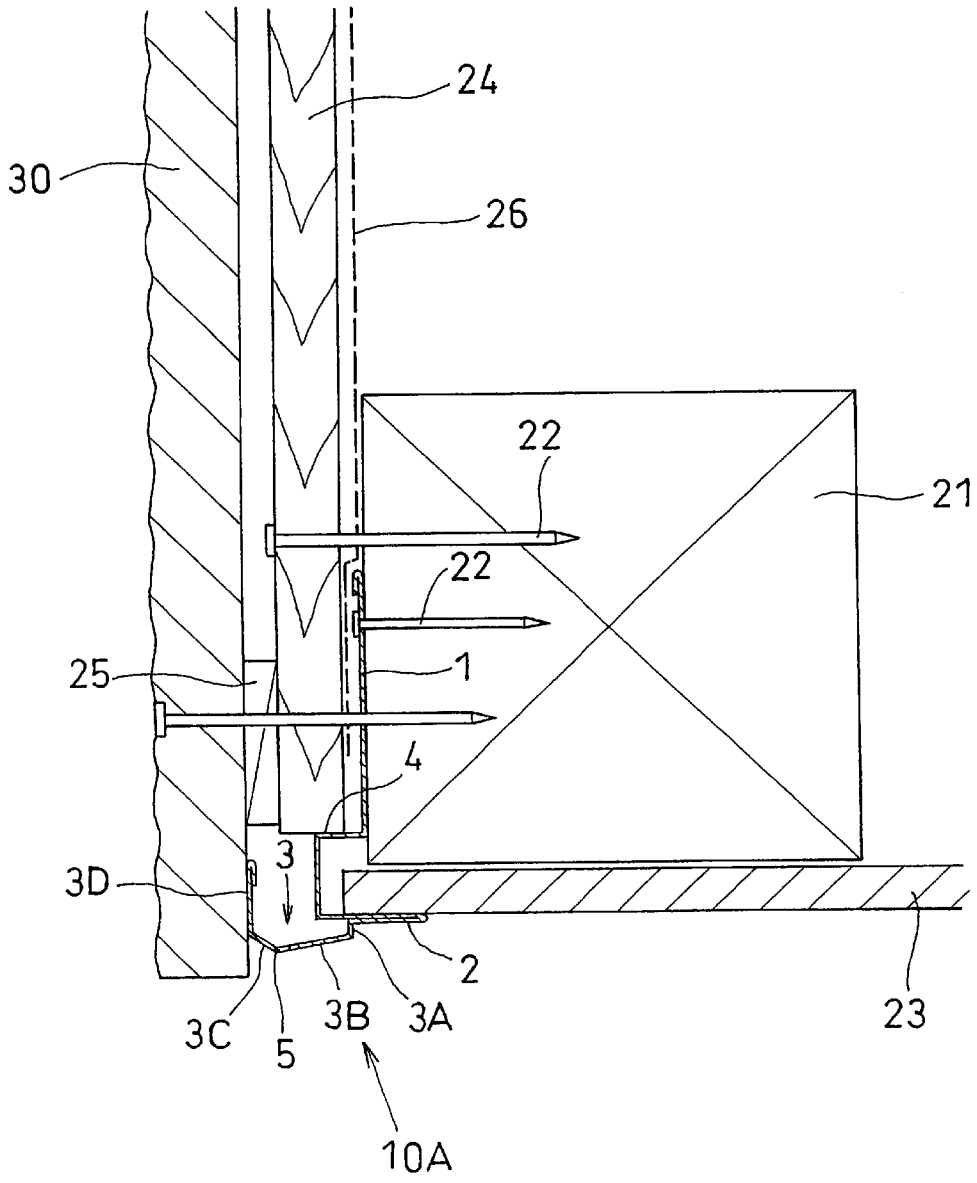
FIG. 3 is a cross-sectional view illustrating a state wherein an overhanging member according to another embodiment of the present invention is attached to an overhanging portion of building.
Figure 4:
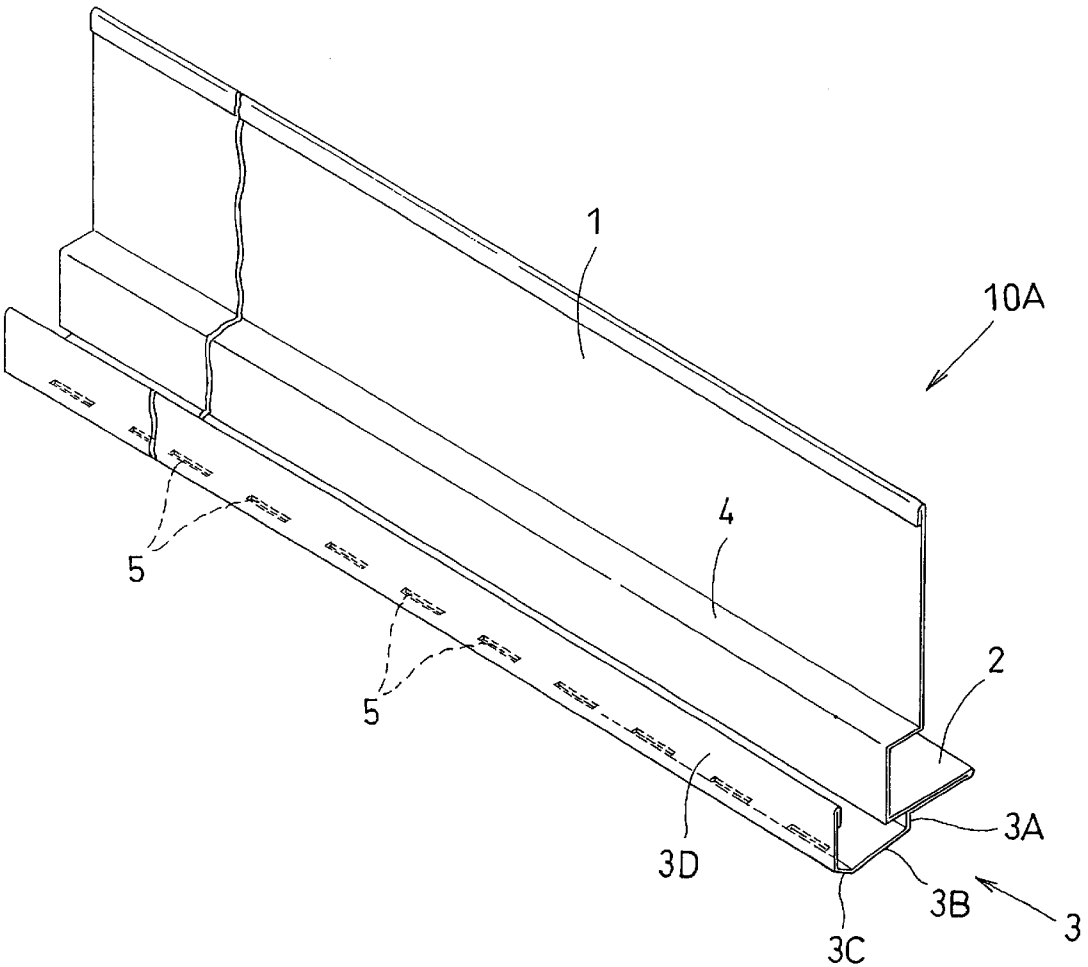
FIG. 4 is a perspective view illustrating the overhanging member shown in FIG. 3.

FIG. 3 is a cross-sectional view illustrating a state of construction wherein an overhanging member according to another embodiment of the present invention is attached to an overhanging portion of building, and FIG. 4 is a perspective view of the overhanging member. The overhanging member 10A in this embodiment differs in the configuration of the trough portion from that of the overhanging member 10 shown in FIGS. 1 and 2. Namely, the trough portion 3 is constituted by a first vertical face 3A which is extended perpendicularly downward from the bottom portion of the rear mounting portion 2; a first inclined face 3B which is extended obliquely downward and forward (the fore side of the flat vertical mounting portion 1) from the lower end of the first vertical face 3A; a second inclined face 3C which is extended obliquely forward and upward from the distal end of the first inclined face 3B; and a second vertical face 3D perpendicularly extending upward from the top end of the second inclined face 3C.

Plurality of slits 5 are formed along the joint line between the first inclined face 3B and the second inclined face 3C. When the trough portion 3 is constructed in this manner, the drainage of water through the slits 5 can be effectively achieved.

Figure 5:
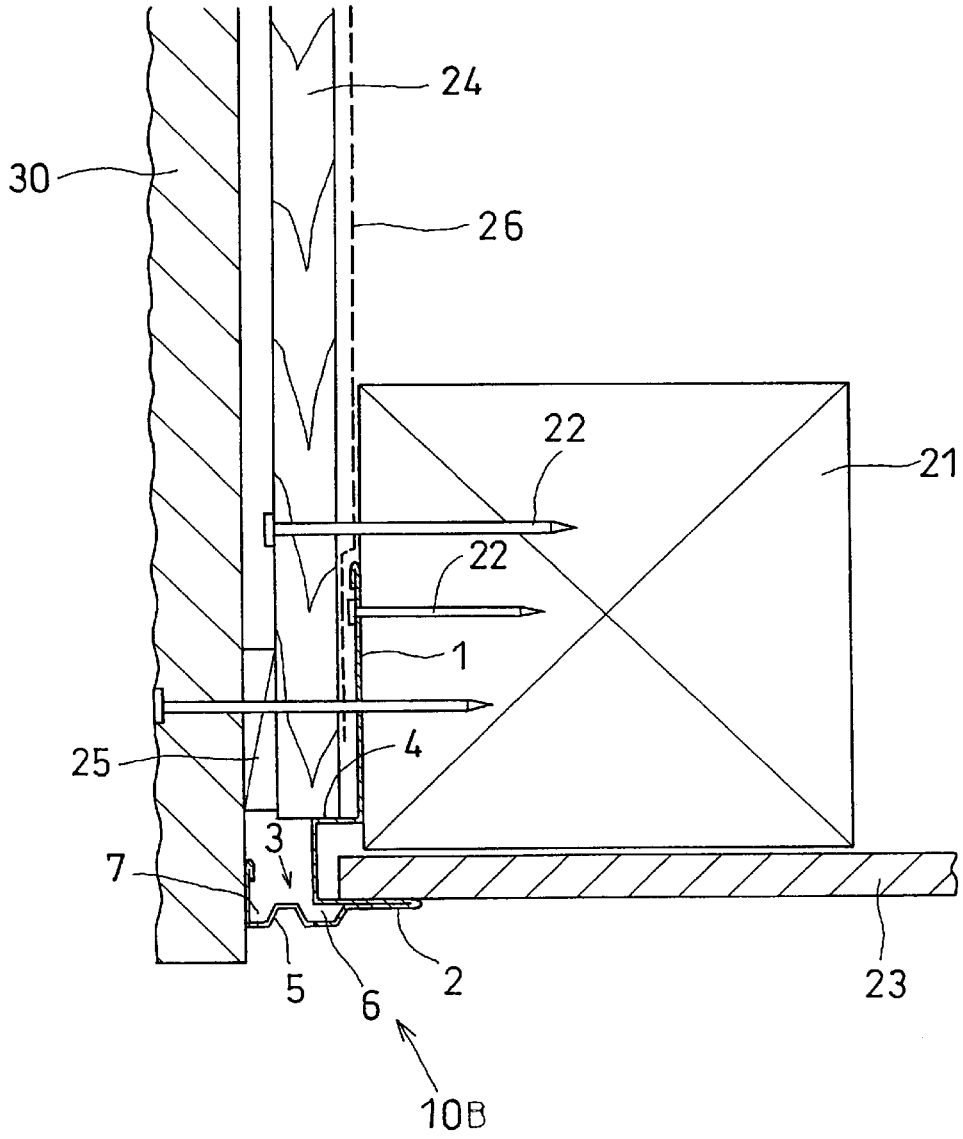
FIG. 5 is a cross-sectional view illustrating a state wherein an overhanging member according to another embodiment of the present invention is attached to an overhanging portion of building.
Figure 6:
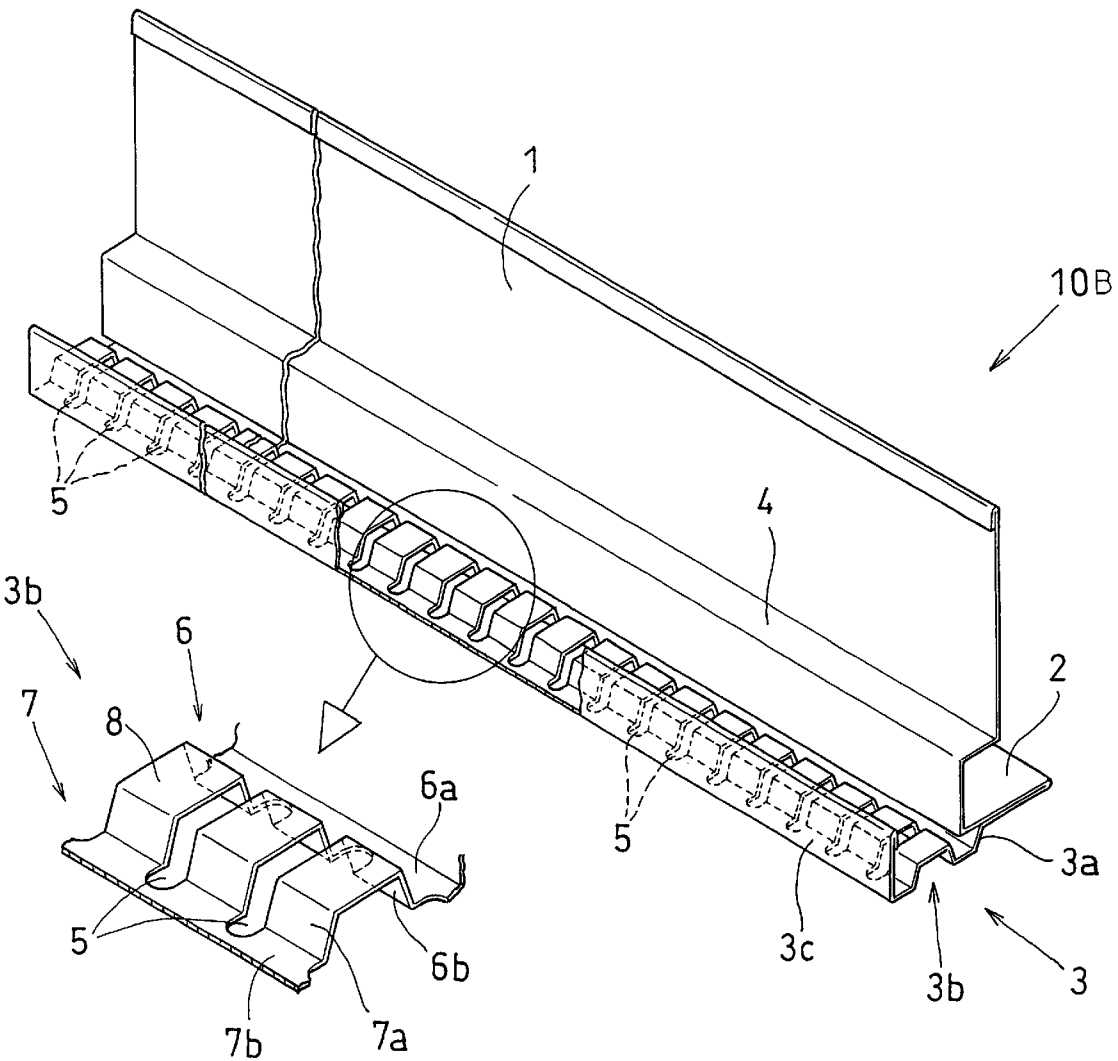
FIG. 6 is a perspective view illustrating the overhanging member shown in FIG. 5 together with a partial enlarged perspective view of FIG. 5.
Figure 7:
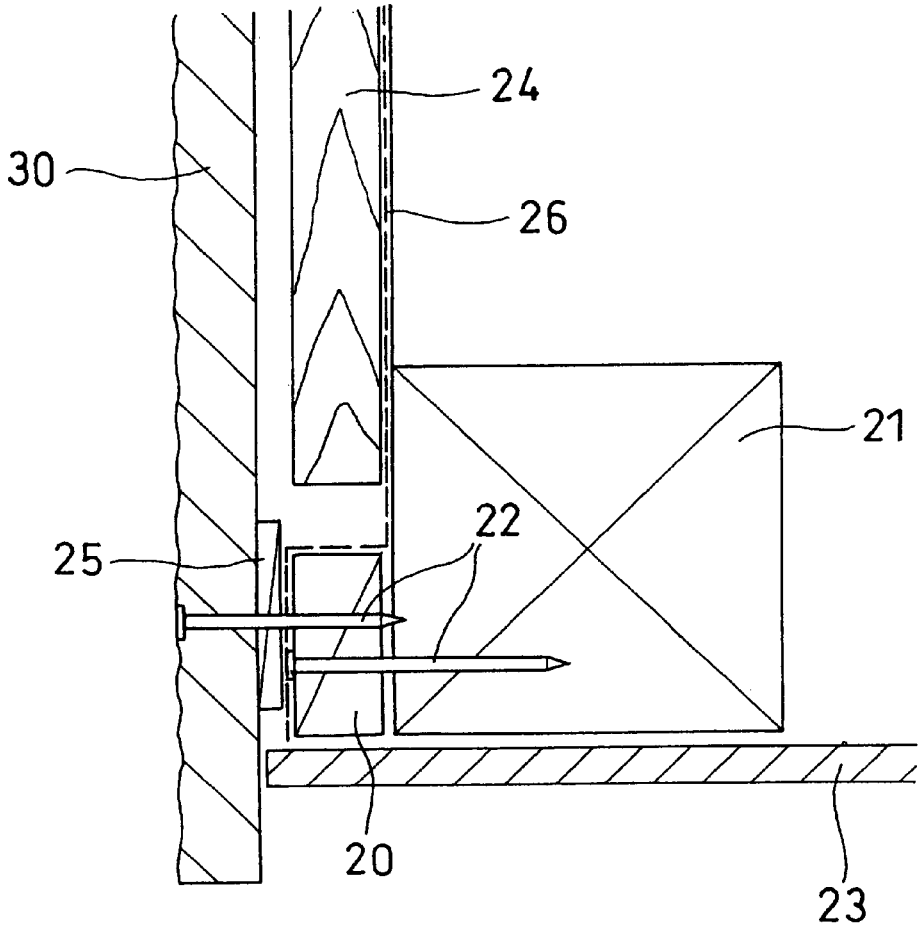
FIG. 7 PRIOR ART
FIG. 7 is a cross-sectional view illustrating one example of the conventional overhanging structure.
Figure 8:
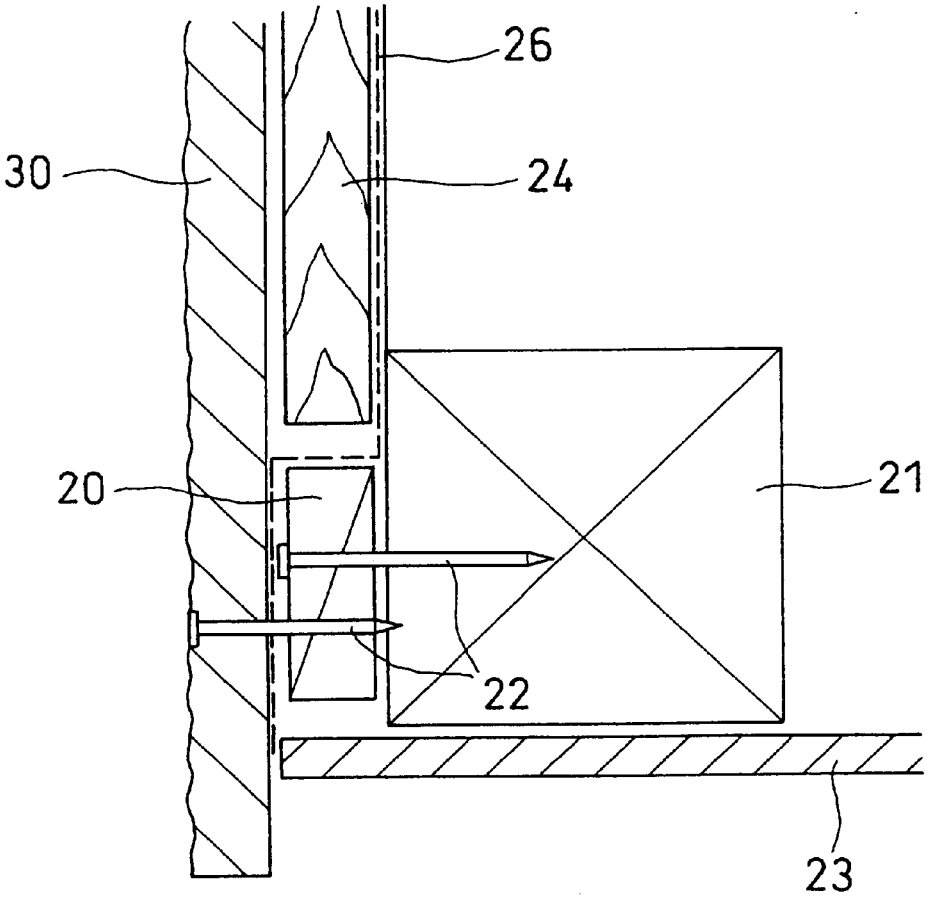
FIG.8 PRIOR ART
FIG. 8 is a cross-sectional view illustrating another example of the conventional overhanging structure.

FIG. 5 is a cross-sectional view illustrating a state of construction wherein an overhanging member according to still another embodiment of the present invention is attached to an overhanging portion of building, and FIG. 6 is a perspective view of the overhanging member. The overhanging member 10B in this embodiment differs in the configuration of the trough portion from that of the overhanging members 10 and 10A shown in FIGS. 1 through 4. FIG. 6 shows a partial enlarged perspective view of the bottom portion 3*b* of the trough portion 3. This bottom portion 3*b* is provided on both rear side and fore side thereof with a first groove portion 6 and a second groove portion 7, respectively. Namely, the bottom portion 3*b* is constituted by a first groove bottom 6*a* which is extended horizontally forward from the distal end of the inclined face 3*a;* a first inclined groove face 6*b* which is extended obliquely upward and forward from the distal end of the first groove bottom 6*a;* a horizontal trough bottom face 8 which is extended horizontally forward from the distal end of the first inclined groove face 6*b;* a second inclined groove face 7*a* which is extended obliquely downward and forward from the horizontal trough bottom face 8; and a second groove bottom 7*b* which is extended horizontally forward from the second inclined groove face 7*a,* wherein the distal end of the second groove bottom 7*b* is contacted with the vertical face 3*c* of the trough portion 3.

Since a couple of grooves 6 and 7 are provided in the bottom 3*b* of the trough portion 3 as described above, Even if the quantity of condensation water to be introduced into the trough portion 3 is not so much, the grooves 6 and 7 function as a conduit, thereby promoting the flow of water. Additionally, holes 5 for discharging water are formed on the bottom 3*b*. These holes 5 are shaped into a slit-like configuration extending perpendicular to the longitudinal direction of the trough portion 3, each of these holes 5 being extended passing through the first groove bottom 6*a;* a first inclined groove face 6*b;* a horizontal trough bottom face 8; a second inclined groove face 7*a;* and a second groove bottom 7*b*. These holes 5 are disposed at equal intervals along the entire length of the trough portion 3. Since the holes 5 are of slit-like configuration, it is difficult to recognize, as the overhanging portion is looked from below, the existence of furring strip 24 which is disposed on the inner side of these holes 5.

The configuration of the holes 5 would not be limited to the above embodiment, but may be shaped into various configurations. Further, the number and location of the holes 5 may be optionally determined. Furthermore, the configuration of the trough portion 3, as well as the number and shape of the grooves 6 and 7 are optionally selected other than those of the aforementioned embodiments. For example, the horizontal trough bottom face 8 may not be formed between these grooves 6 and 7 of this embodiment, but a large number of grooves may be sequentially formed side by side.

Although not shown in the drawings, a V-shaped groove may be formed in advance at the locations on the flat vertical mounting portion 1 where the nails 22 are to be applied, thereby facilitating the nailing of the overhanging member 10 on the occasion of the installation thereof. Further, the holes for nailing may be formed in advance at a predetermined intervals along the V-shaped groove. When the holes for nailing are to be formed in advance, the V-shaped groove may be omitted.

As explained above, it becomes possible, through the employment of the overhanging member of the present invention, to effectively perform the ventilation and drainage at the overhanging portion of building, and to overcome the problem of generating a gap due to the non-uniformity in length of the eaves top board, thus greatly improving the external appearance of the overhanging portion of building.

What is claimed is:

1. An overhanging member comprising:

a flat vertical rear face having a free end;

a substantially u-shaped rabbeted mounting portion extending from a lower end of said flat vertical rear face and opening outwardly in a reward direction; and a trough portion integrally formed with a lower leg of said substantially u-shaped rabbeted mounting portion and extending below and forward of said rabbeted mounting portion and jointed thereto by an angled connecting wall;

said trough portion including a perforated bottom and a front wall extending vertically upwardly from a front end of said perforated bottom and being substantially parallel to said flat vertical rear face and terminating in a free end.

2. The overhanging member according to claim 1, wherein said flat vertical rear face is provided with a nailing portion.

3. The overhanging member according to claim 1, wherein said overhanging member is manufactured through bending a single metal plate.

4. The overhanging member according to claim 1, wherein said trough portion includes at least one groove portion running along the perforated bottom thereof.

5. An overhanging member comprising:

a flat vertical rear face having a free end;

a substantially u-shaped rabbeted rearwardly facing mounting portion extending from a lower end of said flat vertical rear face; and a trough portion integrally formed with and extending below and forward of said substantially u-shaped rabbeted mounting portion;

said trough portion having front and rear grooves extending parallel with said substantially u-shaped rabbeted mounting portion, an elevated bottom portion interconnecting said front and rear grooves, said elevated bottom portion including a plurality of openings extending through the elevated bottom portion and between the front and rear grooves.

6. The overhanging member according to claim 5, wherein said flat vertical rear face is provided with a nailing portion.

7. The overhanging member according to claim 5, wherein said overhanging member is manufactured through bending a single metal plate.

8. The overhanging member as in claim 5, wherein a portion of said substantially u-shaped rabbeted mounting portion is comprised of two contiguous layers of material.

9. The overhanging member as in claim 5, wherein said trough portion includes a front vertical wall terminating with a free end.

* * * * *